United States Patent [19]

Tiedemann

[11] Patent Number: 4,957,258

[45] Date of Patent: Sep. 18, 1990

[54] STAND FOR MOTIONABLY MOUNTING ADVERTISEMENTS

[75] Inventor: Roman Tiedemann, Vienna, Austria

[73] Assignee: Esselte Pendaflex Gesellschaft m.b.H., Vienna, Austria

[21] Appl. No.: 42,062

[22] Filed: Apr. 24, 1987

[30] Foreign Application Priority Data

Apr. 25, 1986 [DE] Fed. Rep. of Germany ..... 8611481

[51] Int. Cl.[5] ..... E04G 3/00

[52] U.S. Cl. ..... 248/292.1; 40/602; 40/608; 248/364; 403/121

[58] Field of Search ..... 248/185, 145, 364, 292.1, 248/596, 289.3; 403/121; 16/277, 280, 284, 289, 296; 40/602, 608

[56] References Cited

U.S. PATENT DOCUMENTS

| | | | |
|---|---|---|---|
| 242,944 | 6/1881 | Lieb | 16/296 X |
| 760,890 | 5/1904 | Mackinder | 16/296 |
| 1,781,161 | 11/1930 | Carrey | 248/596 X |
| 1,856,349 | 5/1932 | Bigelow | 40/602 X |
| 2,059,582 | 11/1936 | Hurewitz | 16/296 X |
| 2,084,818 | 6/1937 | Neil | 40/602 X |
| 2,467,187 | 4/1949 | Capper . | |
| 2,584,404 | 2/1952 | Webb | 16/277 X |
| 2,607,590 | 8/1952 | Wheaton | 248/596 X |
| 2,907,992 | 10/1959 | Bronikowski | 40/608 X |
| 3,521,390 | 7/1970 | Carlson | 40/602 |
| 3,524,615 | 8/1970 | Beasley | 248/145 |
| 3,687,092 | 8/1972 | Manning | 248/188 X |
| 3,880,280 | 4/1975 | Fyvolent | 248/364 X |
| 4,248,001 | 2/1981 | Feuvray | 40/602 |
| 4,258,952 | 3/1981 | Dutra | 248/364 X |
| 4,365,435 | 12/1982 | Snyder, Jr. | 40/602 X |
| 4,553,346 | 11/1985 | Glasener . | |
| 4,599,988 | 7/1986 | Madurski | 248/168 |

FOREIGN PATENT DOCUMENTS

| | | | |
|---|---|---|---|
| 627993 | 3/1936 | Netherlands . | |
| 8523986 | 8/1985 | Netherlands . | |
| WO85/02287 | 5/1985 | PCT Int'l Appl. | 40/602 |
| 531985 | 1/1941 | United Kingdom | 40/608 |
| 834418 | 5/1960 | United Kingdom . | |
| 1428971 | 3/1976 | United Kingdom . | |

*Primary Examiner*—David L. Talbott

*Attorney, Agent, or Firm*—Sixbey, Friedman, Leedom & Ferguson

[57] ABSTRACT

A stand for motionably mounting advertisements, such as placards or the like. The stand comprises a foot-structure (1) placed on the ground and a mount (4) for advertisements such as placards, signs or the like resting on the foot-structure (1) by means of a pendulum support having an approximately horizontal swing axis. A pendulum weight (8) is attached to the mount (4) or the advertisement below the swing axis of the pendulum support. Preferably the pendulum support is equipped with an adjustably pressed brake-disk or a return spring means (11). The return spring means advantageously delivers a return force and frictional damping only beyond a predetermined value a deviation.

26 Claims, 6 Drawing Sheets

STAND FOR MOTIONABLY MOUNTING ADVERTISEMENTS

The invention concerns a stand for motionably mounting advertisements or the like, this stand comprising a foot-structure to be set on the ground and a mount receiving the advertisements and motionably connected to the foot-structure.

A stand of the above type is known, wherein two upwardly projecting springs are provided in the foot structure, and the ends of these springs support a rest for advertising boards. Advertising boards mounted on such a stand away to-and-fro when exposed to air motions and an advertising board subjected to such motions is known to more easily attract viewer interest than a stationary advertisement. It is significant however also that in the presence of strong winds the resulting slant of the boards reduces the surface exposed to the wind and that in addition the resulting obliqueness of the boards increases the pressure of the foot structure on the support surface, thereby improving its stability. Due to the design of the movable support in the form of two springs fixed to the foot structure, this known stand is restricted to a specific of advertising boards format and furthermore, because the springs supporting the mount of the advertising boards also simultaneously deliver the return force opposing the wind force, the behavior pattern of the motion cannot be changed; a further drawback is that the springs of this known stand soon undergo fatigue on account of the various loads on them, whereby the advertising boards assume an oblique rest position.

One object of the present invention is to create a stand of the initially cited kind which evinces a simple design and can be adjusted, i.e. changed in relation to its behavior pattern of the motion and wherein the rest position of the advertisements remains unchanged even after long use.

The stand of the invention being of the type cited initially is characterized in that the mount for the advertisements such as placards, signs or the like rests on the foot structure by means of a pendulum bearing having an approximately horizontal swing axis and in that furthermore a pendulum weight is attached to the mount or to the advertisement below the geometric swing axis of the pendulum bearing. The above set goal can be properly met by this design. The pendulum bearing can be realized in constructive simple manner and allows to change the behavior pattern of the motion of the mount or the advertisement in simple manner, for instance changing the period and the amplitude of the pendulum motion; furthermore it is possible to use a foot-structure with mounts of various sizes, and accordingly it can be used for setting up advertisements having various dimensions.

One advantageous embodiment mode of the stand of the invention allowing easy assembly is characterized in that the pendulum support comprises an approximately horizontal support shaft resting in bearing recesses of a bearing in the foot structure. A variation of this embodiment and well suited for setting up diversely shaped advertisements is characterized in that the pendulum support comprises mutually aligned bearing bolts at the advertisement and entering bearing recesses in a bearing provided at the foot structure. Advantageously the bearing bolts are mounted to clamps which in turn engage the advertisement. It is possible to obtain a damping of the pendulum motion which can be easily adjusted by providing a threaded portion at the free end of at least one bearing bolt or at least one end of the support shaft, which portion extends beyond the bearing recess and which can accept a nut pressing by means of a spring a brake disk against the bearing comprising the pertinent bearing recess.

A preferred embodiment is characterized in that a return-spring means acting on the support shaft or on the bearing bolt is provided at the foot-structure. The return-spring means decreases the amplitude of the pendulum motion, whereby in many cases the legibility or visibility of the information content of the advertising boards will be improved. Especially advantageously the return-spring shall deliver a return force after a specified amount of deviation of the support shaft or bearing bolt from the rest position has been exceeded. In this manner the return spring does not affect extensively or at all the pendulum motion as long as its amplitude remains relatively small, whereby even slight driving forces (for instance a very weak wind) will cause an attention-attracting motion of the advertisements, whereas at larger driving forces, the return-spring will deliver an effective return force and reduce the amplitudes of the pendulum motion and will damp latter. An especially advantageous embodiment of the latter form is characterized in that the bearing recesses seating the support shaft or the bearing bolts are open upward over at least part of their axial extent and in that the ends of the support shaft or the bearing bolts evince flat surfaces at their top sides, and in that elastic small plates or rods being mounted to the bearings provided with the bearing recesses, said small plates or rods extending transversely to the longitudinal direction of the support shaft or of the bearing bolts closely above their flat surfaces and coming to rest against the edges of the flat surfaces upon deviation of the support shaft or bearing bolts. Thereby the bearing of the support shaft in bearing recesses open at the top allows easily inserting this support shaft into the bearings and due to the flats on the top side of the support shaft and the mounting of elastic small plates or rods fastened to the bearings shortly above these flats, a return-spring system of simple construction is realized, which initially leaves the pendulum motion unaffected when the deviations from the rest position are small, and which only at larger amplitudes, when the edges of the flats come to rest against the small plates or rods, will deliver a return force additional to that due to the pendulum weight itself and will also simultaneously generate by means of the sliding of the edges of the flats along the associated small plate or rod an amplitude-reducing frictional damping effect. Similar factors apply to embodiment modes wherein two bearing bolts are provided at the advertisement, which have flats on which the small plates or rods come to rest.

Advantageously furthermore, the small plates shall be fastened by at least one bolt or the like to the bearings and are pressed against it by at least one spring. Another advantageous embodiment is characterized by the small plates being leaf-springs.

In order that the pendulum weight be quite effective, the mount advantageously is provided with a downward pendulum rod supporting the pendulum weight. Transportability is easy, if the advertisement or its mount be a double-walled panel and the pendulum rod be insertable into this panel. A variation of this design is characterized in that the pendulum weight is mounted to a clamp means engaging the advertisement or its mount. Advantageously furthermore the pendulum weight shall be formed by a container which can be filled, as desired or needed, with a weighting material. The embodiment makes it possible to set the return force and therewith the frequency of the pendulum motion by choosing the amount of the filling put into the container. There is a further advantage in that the container can be empty when transporting the stand and that it need being filled with weighting material, water or sand for instance, only when the stand shall be used. However, such a container may also be filled during manufacture and thereby determine the desired behavior of the pendulum motion by a selected amount of filling material.

One embodiment is especially advantageous as regards to the simplicity of its design, and is characterized in that the foot-structure consists of a central part forming a bearing for the pendulum support and of legs hinged therein. This embodiment offers the further advantage that the foot-strucutre can be collapsed for transport. Advantageously furthermore the legs shall consist of the arms of two U-bails which in turn are pivotably supported at their middle on the central foot-structure part, the pivot axes of the two U-bails being mutually parallel and transverse to the swing axis of the pendulum support. In this manner, good footing stability is also obtained.

To achieve a small transport-volume, advantageously the foot-structure central part shall comprise a recess approximately parallel to the pivot axes of the U-bails to receive or pass the support shaft. By means of this embodiment it is possible to rotate the mount by 90°, after the support shaft has been removed from the support, so that the mount together with the legs of the stand forms a flat parcel once these legs have been collapsed, whereby compactness is achieved.

Another simple design also compact in transport and storage is characterized in that the foot-structure consists of a central part forming a bearing for the pendulum support and of legs with can be connected to this central part by threads or plug-in means.

Another embodiment mode especially well suited to mount advertisements displays or the like of the most diverse shapes and sizes is characterized in that the foot-structure consists of two bearings for the two bearing bolts and of legs which can be screwed or plugged onto these bearings. To achieve especially good stability in this case, it is especially advantageous to shape the legs into two U-bails each extending from one bearing to the other and of which the leg-ends are connected to the bearings. Another advantageous embodiment is characterized in that the foot-structure consists of two bearings for the two bearing bolts, of one U-bail of which the leg ends point upward and support the bearings, and of two elongated base feet mounted to the central part of the U-bail.

The invention is discussed in detail below in relation to the embodiment shown schematically in the drawing.

Figure 1:
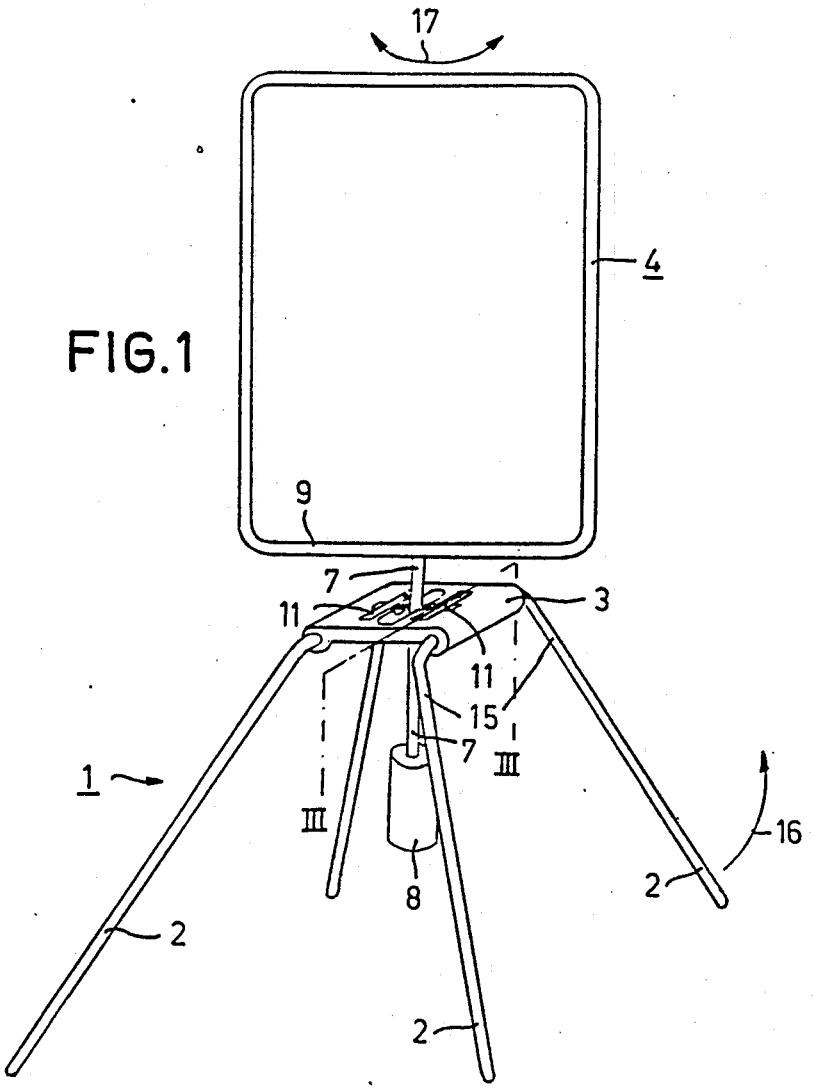
FIG. 1 is an elevation of embodiment of a stand of the invention.

The embodiment mode of a stand shown in FIGS. 1 through 4 comprises a foot-structure 1 consisting of four legs 2 and a foot-structure central part 3. A frame-like mount 4 receiving advertisements such as posters, signs or the like, is supported swinging in pendulum manner from the foot-structure 1. The central part 3 of the foot-structure forms a bearing and comprises upwardly open bearing recesses 5 receiving a support shaft 6 the geometrical axis of which will be approximately horizontal when the stand is operational. This support shaft 6 is connected with the mount 4, specifically in the Example shown in FIGS. 1 through 4 by means of a pendulum rod 7 fastened to the mount 4 and supporting at its free end a pendulum weight 8. The pendulum weight 8 causes the mount 4 to swing back into its rest position shown in FIG. 3. Preferably the pendulum weight 8 is formed by a container which can be filled with a weighting material such as water or sand. The pendulum weight 8 can be detachably fastened to the pendulum rod 7. The pendulum rod 7 is fixed to the lower arm 9 of the frame-like mount 4.

The support shaft 6 comprises flattened surfaces, i.e., flats 10 at its top side and small plates in the form of leaf-springs 11 are mounted to the central part 3 of the foot-structure, which extends transversely to the length of the support shaft 6 and closely above it. These leaf-springs 11 are adjustable by means of screws 12. When the mount 4 respectively the support shaft 6 is pivoted, the support shaft first rotates unhampered and next the leaf-springs 11 come into contact with the edges 14 of the flats 10 (FIG. 4), whereby a rapid return of the mount to its rest position (FIG. 3) and damping of the pendulum motion takes place as soon as the wind force pivoting the mount will stop. The leaf-springs stabilize the mount 4 in its rest position.

Each pair of legs 2 consists of a U-bail 15. These U-bails 15 are pivotably supported at their middle on the central part 3 of the foot-structure. The pivot axes of both U-bails are transverse to the pivot axis of the support shaft 6 supporting the mount 4 in pendular manner. By moving the two U-bails upward, as indicated by the arrows 16, the required storage and transport volume of the stand can be reduced substantially. If additionally after the support shaft 6 has been removed from the bearing recesses 5, the mount 4 is rotated by 90° as indicated by the arrow 17, it will be approximately parallel to the pivot axes of the U-bails. In that position the U-bails then may be laid flat against the mount 4 and these parts then form a flat parcel. The height of this parcel may be reduced further if the pendulum rod 7 is insertable into the mount 4; to that end the mount 4 will be designed as a double-walled panel receiving the pendulum rod. After the mount has been rotated by 90° as mentioned above, the support shaft 6 may be inserted into the recess 20 provided in the central part 3 of the foot-structure, or it may be made to pass through this recess. As a result the mount 4 is placed in an advantageous position relative to the central part 3 of the foot-structure in storage and transportation.

The position provided for the pendulum support of the mount 4 allows presenting displays, placards or the like of different sizes without being forced thereby to change the foot-structure.

Figure 5:
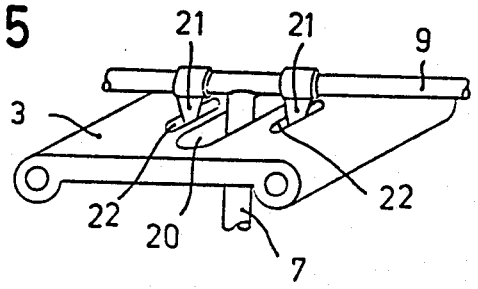
FIG. 5 is a variation of the bearing of a stand of the invention in an elevation corresponding to that of FIG. 2.

In the variation shown in FIG. 5, the mount is pendularly supported by means of studs 21 entering recesses 22 in the central part 3 of the foot-structure. This kind of support is low in friction. In this embodiment mode too a recess 20 is provided in the central part 3 of the foot-structure, which is entered by the studs 21 mounted to the lower arm 9 of the mount when this mount is rotated by 90°, during the collapsing of the stand.

Figure 6:
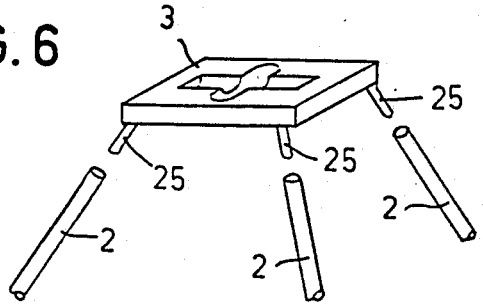
FIG. 6 is an embodiment of the central part of a foot-structure with detachable legs.

In the embodiment of FIG. 6, the legs 2 are mounted in screw-on or plug-in manner to the central part 3 of the foot-structure. Bolts 25 are present at the foot-structure central part 3 to which the legs 2 can be screwed or on which they can be plugged. In lieu of those bolts, bores also may be provided at the foot-structure central part 3 which are sized to suitably plug-in the ends of the legs 3 or which are threaded to match threads provided at one end of the legs 2.

Figure 3:
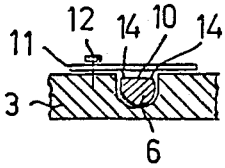
FIG. 3 & 4 are sections through the bearing in a plane passing through the line III—III of FIG. 1.
Figure 4:
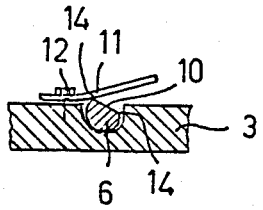
Figure 2:
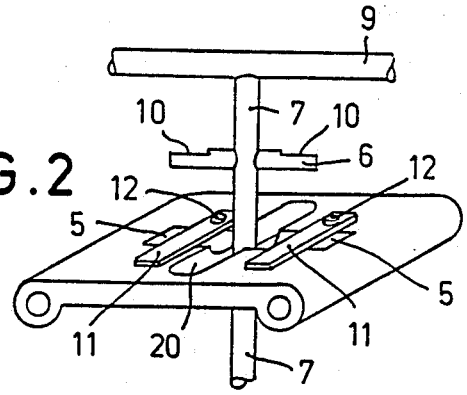
FIG. 2 is also an elevation of the bearing of this stand with pendulum rod when the mount has been removed.
Figure 7:
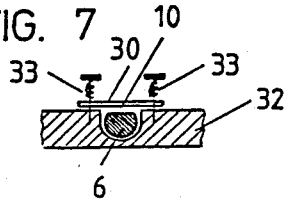
FIGS. 7, 8, 9 are variations of the support shown corresponding to FIGS. 3 & 4.
Figure 8:
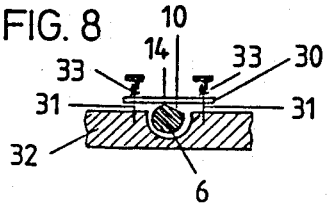

In the embodiment of the pendulum support shown in FIGS. 7 and 8, contrary to the embodiment of FIGS. 3 and 4, a rigid small plate 30 is mounted above the flat 10 of the support shaft or bearing bolt. The small plate 30 is held by two screw bolts 31 on the bearing 32 and is pressed against it by helical springs 33. By rotating the screw bolts 31 into corresponding threaded bores in the bearing 32, the helical springs 33 are compressed to keep the small plate in adjustable pre-stress on the bearing and, upon deviation of the support shaft or the bearing bolt, to keep it in contact with the edges 14 of the flat.

Figure 9:
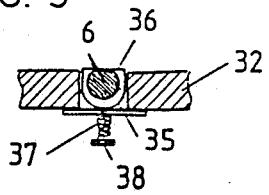

In the embodiment of FIG. 9, a ring 35 is placed on the section of the support shaft or bearing bolt evincing the flat 10. This ring has a straight segment 36. The segment 36 of the ring 35 forms a rod resting on the flat 10. The ring 35 is pulled down by a spring 37. The effective force of the spring 37 determining the rod pressure on the flat is adjustable by a nut 38 screwed on a bolt mounted to the ring 35 and passing through the spring 37. The spring 37 rests against the bearing 32.

Figure 10:
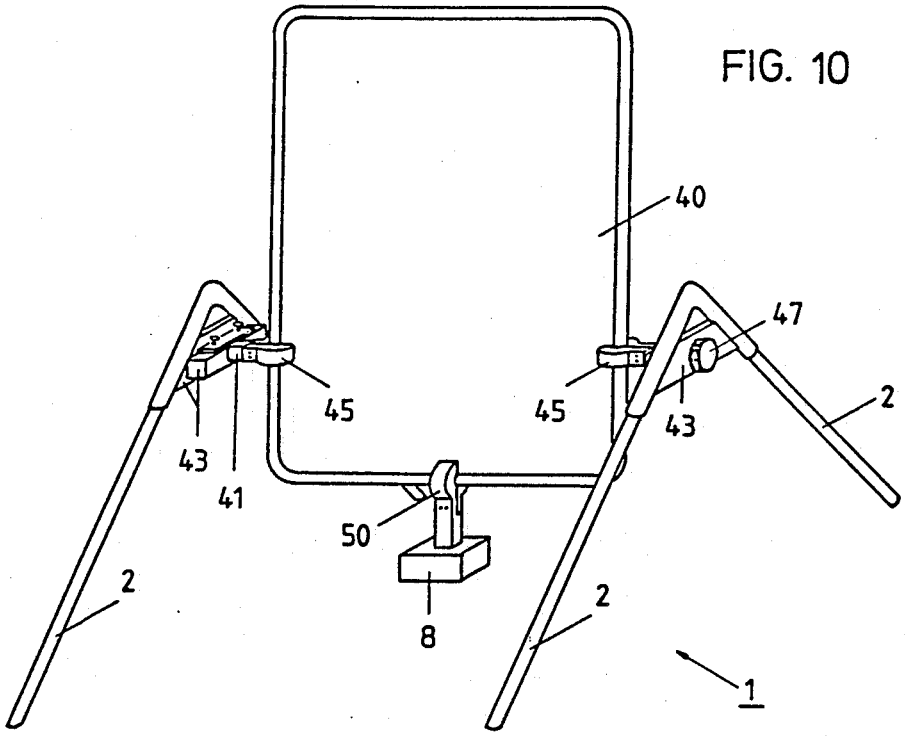
FIG. 10 is an elevation of a further embodiment of a stand of the invention.
Figure 11:
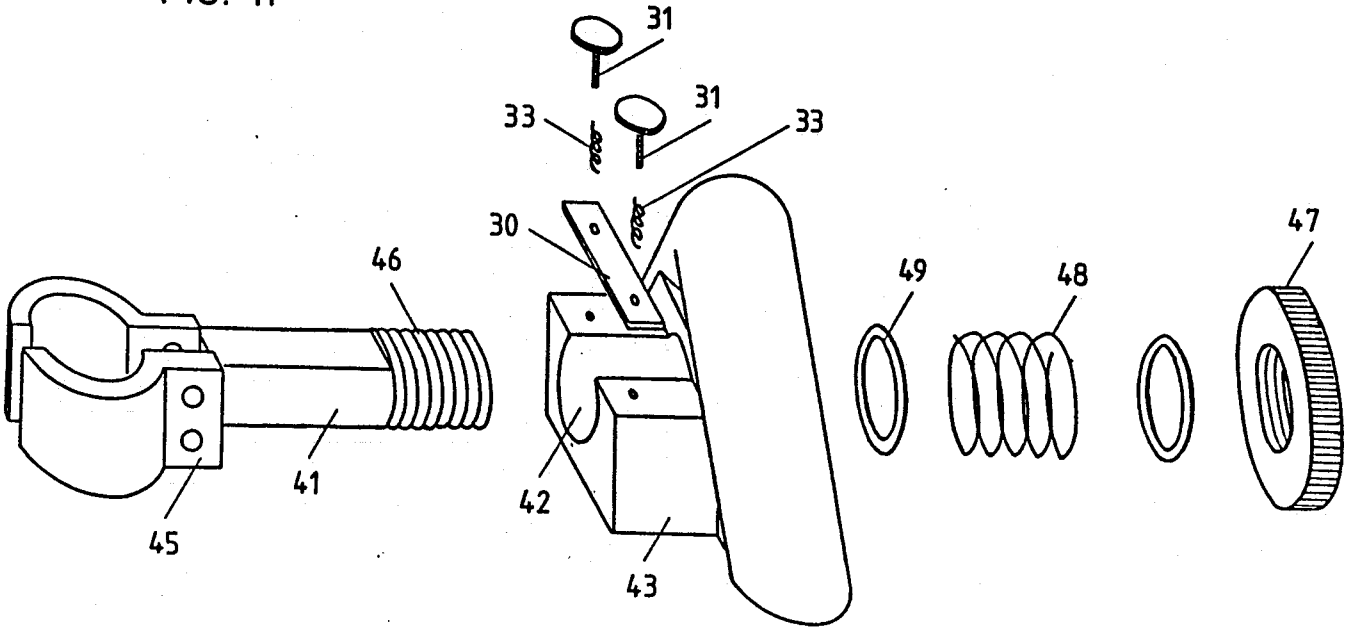
FIG. 11 is an exploded view of the pendulum support of that stand.

In the embodiment of a stand of the invention shown in FIGS. 10 and 11, the pendulum support comprises two mutually aligned bearing bolts 41 mounted to a advertisement 40 and entering bearing recesses 42 present in bearings 43 of the foot-structure. The advertisement 40 is shown as a frame though it also may assume other shapes for instance a three dimensional model of the objects to be advertised.

The bearing bolts 41 are mounted to clamps 45 in turn engaging the advertisement 40. At the free end of at least one bearing bolt 41 there is a threaded portion 46 projecting beyond the associated bearing recess 42 and receiving a nut 47 in the form of knob which, by means of a spring 48, presses a brake-disk 49 against the bearing 43; the braking or damping of the pendular motion is adjustable by resetting the nut 47. Moreover flats 10 are provided on the bearing bolt 41 to reduce the amplitude and to damp the pendular motion, and the bearings 43 are upwardly open in the region of the flats 10. Small elastic plates 30 are mounted above the flats 10 and similarly to the case of FIGS. 7 and 8, are pressed by helical springs 33 of which the force is adjustable by means of screw-bolts 31, against the bearing. As already discussed above, the small plates 30 will come to rest against the flats 10 or their edges 14 when the bearing bolts 41 are moved out of their rest position. In this embodiment the pendulum weight 8 is mounted to a clamp 50 acting on the advertisement 40. In this case too the pendulum weight may consist of a container which may be filled as desired with a weighting material.

In the embodiment of FIGS. 10 and 11, the foot-structure consists of two bearings 43 and of legs 2 connected to them in screw-on or plug-in manner.

Figure 12:
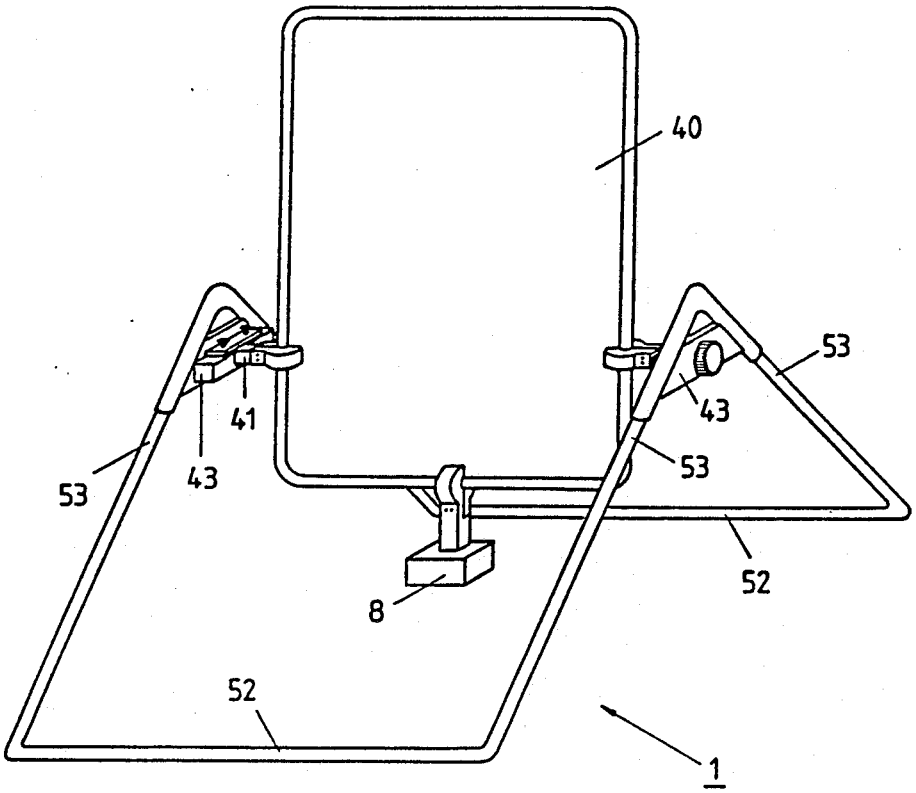
FIGS. 12, 13 are two variations of the stand of FIG. 10.

The embodiment of FIG. 12 differs from that of FIGS. 10 and 11 in the design of the legs by means of two U-bails 52 each extending from one bearing to the other and the leg-ends 53 of which are connected to the bearings 43. This design offers good footing stability.

Figure 13:
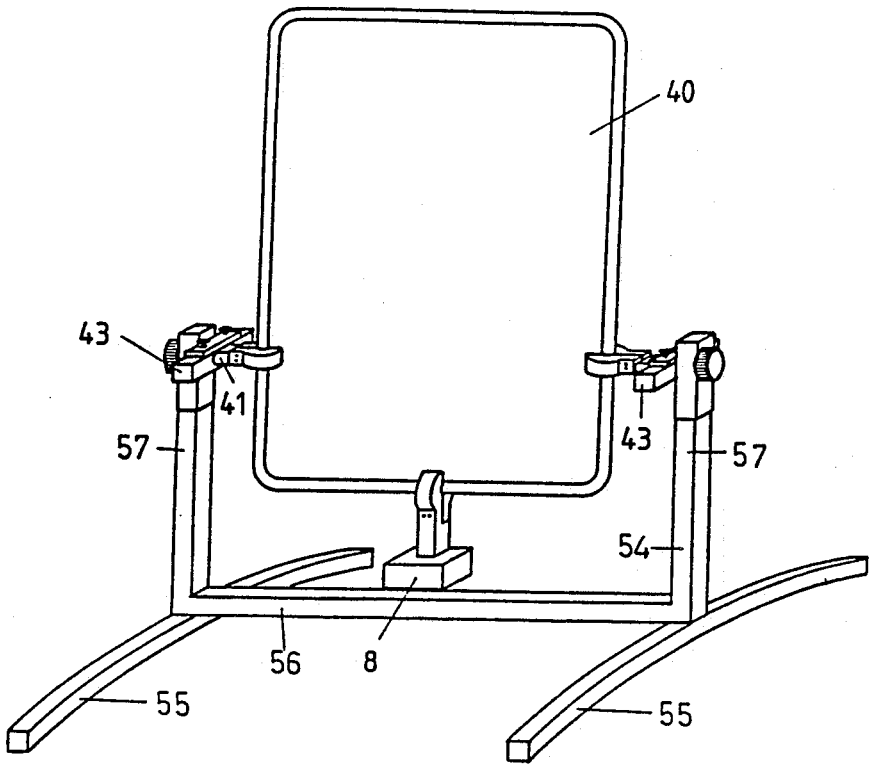

The embodiment of FIG. 13 comprises a foot-structure consisting of a U-bail 54 and two elongated base-feet 55. The base-feet are mounted to the central part 56 of the U-bail. The bearings 43 of the pendulum support ——designed similarly to the embodiment of FIGS. 10 and 11 ——are mounted to the leg ends 57 of the U-bail 54.

What is claimed:

1. A stand for motionably mounting advertisements such as placards or signs comprising a foot-structure to be placed on the ground and a mount receiving the advertisement and displaceably connected to the foot-structure, wherein the mount for the advertisements rests on the foot-structure by means of a pendulum bearing support having an approximately horizontal swing axis, and wherein a pendulum weight is attached to the mount or to the advertisement below the swing axis of the pendulum bearing such that said pendulum weight tends to return the advertisement to a rest position when external forces are not present, said stand further including bias return means for exerting a return force toward said rest position only after a predetermined magnitude of movement away from said rest position has been exceeded.

2. Stand defined in claim 1, wherein the pendulum support comprises an approximately horizontal support shaft (3) resting in bearing recesses of a bearing (3) in the foot-structure.

3. The stand of claim 2, wherein at least a portion of the bearing recesses open upwardly, said support shaft including flat surfaces at a top side thereof, said bias return means including bias members mounted above said flat surfaces adjacent said upwardly open bearing portions and extending transverse to a longitudinal direction of the support shaft, whereby edges of said flat surfaces engage said bias members when said advertisement moves from said rest position by the predetermined magnitude of movement.

4. The stand of claim 3, wherein said bias members each include a small plate and a bolt fastening said plates to the bearing support, said bias return means further including springs biasing said plates toward said bearing.

5. The stand of claim 4, wherein said springs are helical springs mounted on said bolts, whereby said spring can be compressed by rotation of said bolts.

6. The stand of claim 3, wherein said bias members comprise leaf springs.

7. The stand of claim 3, further including rings placed over portions of the flat surfaces of the support shaft, said rings having a rectilinear section forming a rod resting on the associated flat surfaces, and spring means for pulling down said rings and pressing the rod against the associated flat surface.

8. Stand defined in claim 1, wherein the pendulum support comprises two mutually aligned bearing bolts mounted at the advertisement and entering bearing recesses in a bearing provided at the foot-structure.

9. Stand defined in claim 8, wherein the bearing bolts are mounted to clamps which in turn engage the advertisement.

10. Stand defined in claim 8, characterized in that at the free end of at least one bearing bolt a threaded portion is present which extends beyond the bearing recess and which receives a nut pressing by means of a spring a brake-disk against the bearing comprising the pertinent bearing recess.

11. The stand as set forth in claim 8, wherein at least a portion of the bearing recesses open upwardly, said bearing bolts including a flat surface at top sides thereof, said bias return means including bias members mounted above said flat surfaces adjacent said bearing recesses and extending transverse to a longitudinal direction of the bearing bolts, whereby edges of said flat surfaces engage said bias members when said advertisement moves from said rest position by the predetermined magnitude.

12. The stand of claim 11, wherein said bias members each include a small plate and a bolt fastening said plate to the bearing support, said bias return means further including springs biasing said plates toward said bearing.

13. The stand of claim 12, wherein said springs are helical springs mounted on said bolts, whereby said springs can be compressed by rotation of said bolts.

14. The stand of claim 11, wherein said bias members comprise leaf springs.

15. Stand defined in claim 8, wherein the pendulum weight is mounted to a clamp engaging the advertisement or its mount.

16. Stand defined in claim 8, wherein foot-structure consists of two bearings for the two bearing bolts and of legs which can be connected in threaded or in plug-in manner with said bearings.

17. Stand defined in claim 16, wherein the legs consist of two U-bails each extending from one to the other bearing and of which the leg ends are connected to the bearing.

18. Stand defined in claim 8, wherein the foot-structure consists of two bearings for the two bearing bolts, of a U-bail with upward pointing leg-ends supporting the bearings and of two elongated base feet mounted to the central part of the U-bail.

19. Stand defined in claim 1, wherein the bias return means are provided on the foot-structure.

20. Stand defined by either claim 1, the mount is provided with a downward pendulum rod supporting the pendulum weight.

21. Stand defined in claim 20, wherein the advertisement or its mount is a double-walled panel and in that the pendulum rod can be inserted into this panel.

22. Stand defined by claim 1, wherein the pendulum weight is a container which can be filled as desired or needed with a weighting material.

23. Stand defined in claim 1, wherein the foot-structure consists of a central-part and of legs hinged therein.

24. Stand defined in claim 23, wherein the legs consist of the arms of two U-bails pivotably supported at their middle at the foot-structure central part, the pivot axes of the two U-bails being mutually parallel and transverse to the swing axis of the pendulum support.

25. Stand defined in claim 24, wherein the foot-structure central part comprises a recess approximately parallel to the pivot axes of the U-bails to receive or to pass the support shaft.

26. Stand defined in claim 1, wherein the foot structure consists of a foot-structure central part forming a bearing for the pendulum support and of legs which can be connected in threaded or plug-in manner with said central part.

* * * * *